US005108518A

United States Patent [19]

Fukui et al.

[11] Patent Number: 5,108,518

[45] Date of Patent: Apr. 28, 1992

[54] METHOD OF PRODUCING THIN HIGH CARBON STEEL SHEET WHICH EXHIBITS RESISTANCE TO HYDROGEN EMBRITTLEMENT AFTER HEAT TREATMENT

[75] Inventors: Kiyoshi Fukui, Nishinomiya; Atsuki Okamoto, Ashiya, both of Japan

[73] Assignee: Sumitomo Metal Industries, Ltd., Osaka, Japan

[21] Appl. No.: 626,830

[22] Filed: Dec. 13, 1990

[30] Foreign Application Priority Data

Dec. 18, 1989 [JP] Japan ..... 1-328699

[51] Int. Cl.[5] ..... C21D 8/00

[52] U.S. Cl. ..... 148/12 R; 148/12 F

[58] Field of Search ..... 148/12 F, 12 R, 330, 148/334

[56] References Cited

U.S. PATENT DOCUMENTS 4,406,711 9/1983 Nagumo et al. ..... 148/12 F
4,472,208 9/1984 Kunishige ..... 148/12 F

FOREIGN PATENT DOCUMENTS 0023025 2/1982 Japan .
0211526 11/1984 Japan .
1159534 7/1986 Japan .
0145718 6/1988 Japan .

*Primary Examiner*—R. Dean
*Assistant Examiner*—Sikyin Ip
*Attorney, Agent, or Firm*—Burns, Doane, Swecker & Mathis

[57] ABSTRACT

A method of manufacturing a thin steel sheet of high carbon steel which has a high level of strength and exhibits excellent resistance to hydrogen embrittlement after heat treatment is disclosed. The steel consists essentially of, by weight %:

C: 0.30–0.70%,
Si: 0.10–0.70%,
Mn: 0.05–1.00%,
P: not greater than 0.030%,
S: not greater than 0.020%,
Cr: 0.50–2.00%,
Mo: 0.10–0.50%,
Ti: 0.005–0.10%,
Nb: 0.005–0.100%,
sol. Al: not greater than 0.10%,
N: greater than 0.0020%, but not greater than 0.015%,
optionally B: 0.0005–0.0020%, and
a balance of iron and incidental impurities, the method comprising the steps of:

hot rolling a steel having the above defined chemical composition with a finishing temperature of 800° C. or higher;

immediately after finishing the hot rolling cooling the hot rolled steel at a cooling rate of 5°–40° C./second to a temperature range of 500°–700° C.; and coiling the hot rolled steel at a temperature of 450°–650° C.

8 Claims, 4 Drawing Sheets

METHOD OF PRODUCING THIN HIGH CARBON STEEL SHEET WHICH EXHIBITS RESISTANCE TO HYDROGEN EMBRITTLEMENT AFTER HEAT TREATMENT

BACKGROUND OF THE INVENTION

The present invention relates to a method of manufacturing a thin steel sheet of high carbon steel, and particularly to a method of manufacturing a carbon steel sheet which has a very fine crystal grain structure after heat treatment and which is superior to a conventional thin steel sheet with respect to resistance to mechanical shock and wear, and which can successfully prevent cracking caused by hydrogen infiltrated into the steel during use.

The steel sheet of the present invention is easy to produce and easy to work, and therefore, it is suitable for forming a variety of articles including chain elements, gear members, clutch members, buckles for seat belts, and washers.

In general, such articles are manufactured from a high carbon steel such as S30CM, S70CM, SK7M, or SK4M and a low alloy high carbon steel such as SCM435 or SCM445 as specified in JIS G 3311. These high carbon steels and low alloy, high carbon steels are, if necessary after hot rolling and descaling by pickling, subjected to cold rolling with a certain degree of reduction in area as well as spheroidizing by heating the steel at a temperature of around the $Ac_1$ point for an extended period of time in order to improve the accuracy of the thickness of the sheet and formability including its suitability for blanking, bending, and pressing which are usually carried out by customers. After forming into a final shape, heat treatment such as quenching and tempering, austempering, and the like is performed to harden the article being manufactured, resulting in improvement in the resistance to wear and mechanical shock.

Therefore, steel sheet for use in manufacturing these articles must exhibit a relatively high degree of strength as well as shock- and wear-resistant properties only after heat treatment. For this purpose it is necessary to employ steel with a high carbon content. Since the shock- and wear-resistant properties of the final articles are influenced by heat treatment conditions, and especially the tempering temperature, steel sheet "as quenched" or steel sheet "tempered at 650° C. or lower" (usually 180°–450° C.) in the case of quenched material, or steel sheet austempered at a temperature of 500° C. or lower (usually 200°–450° C.) in the case of austempered material are carefully chosen depending on the properties required for the use.

However, since thin steel sheet of high carbon steel, especially that with a higher content of carbon suffers from an increase in strains in the steel and precipitation of a large amount of carbides in the course of heat treatment, it is inevitable that the shock-resistance as well as the resistance to hydrogen embrittlement are insufficient, even if the heat treatment conditions are determined carefully.

SUMMARY OF THE INVENTION

However, according to the experience of the inventors, when such a high strength steel is used, cracking occurs in an area where stress is concentrated during use thereof, and observation of the fractured surface shows that the fracture is caused by intergranular fracture. The inventors of the present invention found that such cracking is caused by the hydrogen which penetrates into the steel during its use. This is hereunder called hydrogen embrittlement.

Therefore, it is a general object of the present invention to provide a method of manufacturing a thin steel sheet of high carbon which exhibits excellent resistance to mechanical shock and wear as well as to hydrogen embrittlement.

In order to avoid hydrogen embrittlement it is necessary to suppress an increase in strains due to a high content of carbon. For this purpose, it is advisable to employ a CrMo system, low-alloy steel, such as SCM435, and SCM445, which contains a reduced amount of carbon.

Furthermore, it is also advisable to prepare a fine austenitic crystal grain structure and to prevent propagation of cracking within the steel. For this purpose it is necessary to suitably adjust the chemical composition of the steel including chemical components such as Al and N. In particular, in order to refine the austenitic grain structure it is common to precipitate fine particles of AlN and the like during slab heating, or soaking before quenching or austempering.

However, in order to provide more finely divided austenitic crystal grains, it is necessary to increase the amount of precipitates other than AlN and the like. The inventors conceived of adding Ti and Nb to precipitate TiN, TiC, Ti(CN), NbC, Nb(CN), or TiNb(CN) the presence of which can promote refinement of the crystal grains efficiently.

There is a current trend to improve shock-resistance and the resistance to hydrogen embrittlement by austempering instead of by quenching and tempering. It is also required to further shorten the length of time required for achieving heat treatment including quenching and tempering, and austempering for automobile components because an increasingly large number of components are used for assembling a modern automobile and the processing time for each component should be minimized. However, in the case of the above-described low alloy steel, when the heating time for preparing an austenitic structure before austempering is shortened, sometimes transformation from a pre-structure, i.e., ferrite-pearlite structure into an austenitic structure does not take place sufficiently, resulting in a local concentration of carbon, which causes formation of a mixed structure of martensite and bainite after austempering. The presence of such a mixed structure adversely affects the shock-resistance and the resistance to hydrogen embrittlement. Thus, it is necessary to prevent formation of such a mixed structure but to form a uniform bainite structure so as to improve such properties.

It is a specific object of the present invention to provide an economical and practical method of manufacturing a thin steel sheet of high carbon steel which has finely divided crystal grains and exhibits excellent resistance to mechanical shock and wear, as well as to hydrogen embrittlement.

The inventors of the present invention made the following discoveries.

(a) In the past, it was thought to be impossible to completely prevent a high strength steel from suffering from hydrogen embrittlement and fatigue fracture. However, even for such a high strength steel, when a specific amount of Nb (0.005–0.100%) is incorporated into the steel, austenitic grains are finely divided and the cracking due to hydrogen embrittlement is suppressed markedly.

(b) Additionally, 0.005–0.10% of Ti is added, Ti(CN) and TiNb(CN) are formed during slab heating, or soaking before quenching or austempering to markedly suppress the grain growth of austenite phase.

(c) When the content of P is reduced to 0.030% or less, the amount of P precipitated along austenitic grain boundaries is also reduced, resulting in an improvement in the toughness of the resulting material. The presence of a large amount of P precipitated along grain boundaries causes grain boundary embrittlement, sometimes resulting in brittle fracture.

(d) It is known that when a suitable amount of B is added, B precipitates along grain boundaries preferentially to P so that the precipitation of P is suppressed. Therefore, it has also been proposed to incorporate B in steel so as to prevent the precipitation of P along grain boundaries. The present inventors found that the addition of B is also effective to avoid hydrogen embrittlement by further strengthening grain boundaries.

(e) When the S content is reduced to 0.020% or less, a reduction in the Mn content can greatly improve toughness because formation of MnS is eliminated. In contrast, when the Mn content is high, due to the presence of a high amount of Mn, the precipitation of P along grain boundaries is promoted. However, when the Mn content is lowered, the precipitation of P along grain boundaries can be successfully prevented. Usually when the Mn content is small, it is expected that hardenability is degraded, but the steel sheet manufactured by the present invention is very thin, and hardenability is not so serious a problem. In addition, due to incorporation of Cr and Mo, the strength of the resulting steel is ensured.

(f) Generally, it is inevitable that formability or punchability before quenching and tempering are degraded for a high carbon steel sheet with improved toughness. However, when a specific amount of Mo is incorporated as an alloying element, a degradation in toughness after quenching and tempering, particularly that called "tempering embrittlement at low temperatures" can be avoided successfully.

(g) When the finishing temperature is defined as 800° C. or higher, a ferrite-pearlite grain structure after hot rolling can be further refined, resulting in a uniform structure after heat treatment with improvement in the resistance to mechanical shock and hydrogen embrittlement.

(h) When the cooling rate after hot rolling is defined as 10–40° C./second, proeutectoid ferrite grains in the hypoeutectoid composition range can be successfully refined. Therefore, the length of heating can be shortened in the austenitic temperature range during soaking carried out before quenching-tempering or austempering.

(i) When a hot rolled sheet is coiled in the temperature range of 550°–650° C., a refinement of the above-mentioned proeutectoid ferrite grains can be promoted more successfully, resulting in a shortening of the time for soaking in the austenitic temperature range before quenching-tempering or austempering.

On the basis of these discoveries, the inventors disclosed steels containing Nb, Cu, Ti, and B in Japanese Patent Applications No. 311136 and 301815/1988. These steels have excellent toughness, but they are expensive since they contain Cu which is indispensable for improving the resistance to hydrogen embrittlement on the surface of a steel sheet.

A steel composition similar to the above-defined one is disclosed in Japanese Patent Publication No. 35066/1989, in which the N content is restricted to 0.0020% or less and the P content is restricted to 0.010% or less so as to obtain clean grain boundaries. In this case, however, the grain size after quenching-tempering or austempering becomes coarse, resulting in a degradation in the resistance to shock and hydrogen embrittlement. In addition, the steel disclosed in that patent application is mainly used for manufacturing rods, bars, and the like, so that application does not suggest anything about heat treatment of a thin steel sheet or about defects associated therewith.

The present inventors have confirmed on the basis of the above-described discoveries not only that manufacturing costs can be markedly reduced but also that the resistance to mechanical shock and hydrogen embrittlement can be improved markedly by (i) eliminating the incorporation of copper, (ii) restricting the N content to larger than 0.0020% but not larger than 0.015%, (iii) adjusting the steel composition so as to contain a sufficient amount of Ti, Al, and Nb-containing carbonitride, and further (iv) adjusting the hot rolling conditions such that a fine ferrite-pearlite grain structure will be formed.

The present invention resides in a method of manufacturing a thin steel sheet of high carbon steel which has a high level of strength and exhibits excellent resistance to hydrogen embrittlement after heat treatment and which has the following chemical composition which consists essentially of, by weight%:

C: 0.30–0.70%,
Si: 0.10–0.70%.
Mn: 0.05–1.00%,
P: not greater than 0.030%,
S: not greater than 0.020%,
Cr: 0.50–2.00%,
Mo: 0.10–0.50%,
Ti: 0.005–0.10%,
Nb: 0.005–0.100%,
sol. Al: not greater than 0.10%,
N: greater than 0.0020%, but not greater than 0.015%, optionally B: 0.0005–0.0020%, and
a balance of iron and incidental impurities, the method comprising the steps of:
hot rolling a steel having the-above defined chemical composition with a finishing temperature of 800° C. or higher;
immediately after finishing the hot rolling cooling the hot rolled steel sheet at a cooling rate of 5°–40° C., preferably 10°–40° C./second to a temperature range of 500°–700° C., preferably 550°–650° C.; and
coiling the hot rolled steel sheet at a temperature of 450°–650° C., preferably 550°–650° C.

Optionally, the present invention may further comprise the step of carrying out one or more times cold rolling with a reduction of 20–80% and box annealing at a temperature of $(Ac_1-50)$ to $(Ac_1+30)$° C.

Thus, according to the present invention, a bainite structure can be produced in an extremely short time by applying heat treatment such as austempering.

DESCRIPTION OF THE PREFERRED EMBODIMENTS

Figure 1:
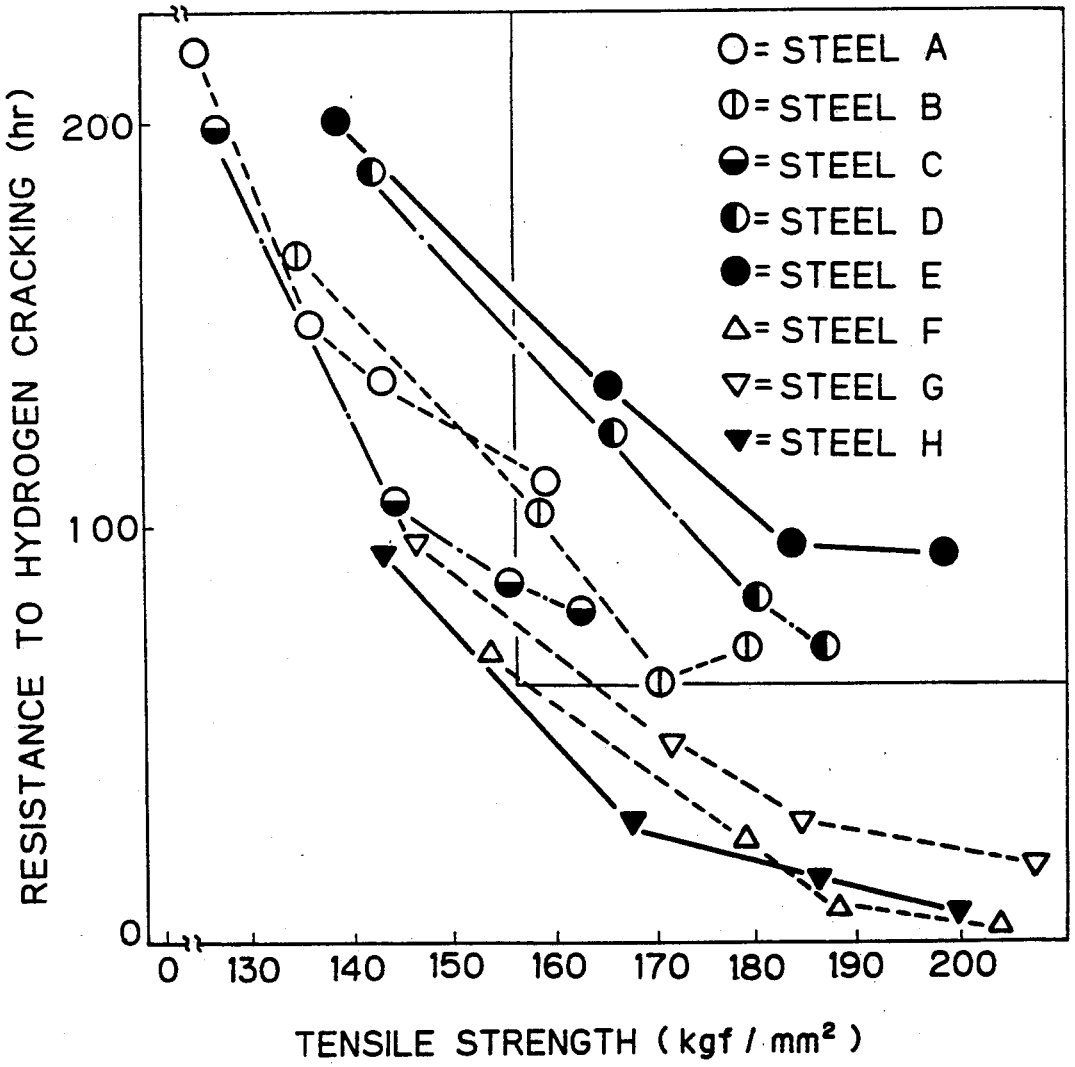
FIG. 1 through FIG. 4 are graphs showing results of working examples of the present invention.

The reasons for defining the steel composition which is processed by the present invention as above will now be described.

(a) C (Carbon)

In order to provide a steel with a satisfactory level of hardness, strength, hardenability and wear resistance 0.30% or more of carbon is added. When the carbon content is over 0.70%, formability before heat treatment is degraded and toughness after heat treatment is much impaired. Therefore, in the present invention the carbon content is defined as 0.30–0.70%, and preferably 0.40–0.60%.

(b) Si (Silicon)

The addition of Si is not absolutely necessary. When the content of Si is over 0.70%, there is a tendency for the steel to become hard and brittle to some extent. The Si content is restricted to not greater than 0.70%. At least 0.10% of Si is added so as to ensure hardenability.

(c) Mn (Manganese)

The high carbon steel sheet of the present invention which contains Cr and Mo is mainly used for making gears, chains and the like. In contrast to conventional wear-resistant steel sheet for general use the content of Mn is reduced in the present invention so as to improve toughness. Therefore, it is desirable that the Mn content be so small as to improve toughness. In fact, when the amount of Mn is over 1.0%, the hardness after heat treatment is much greater than that required, resulting in a degradation in toughness. On the other hand, when the Mn content is lower than 0.05%, the amount of sulfur which is dissolved in the steel increases and embrittlement during hot working is inevitable, resulting in a degradation in productability of steel sheet. The Mn content is restricted to 0.05–1.00%, and preferably not greater than 0.80%.

(d) P (Phosphorous)

Phosphorous precipitates along grain boundaries of austenite before transformation, and it has a great influence on degradation in the resistance to embrittlement such as intergranular fracture. Therefore, the lower the phosphorous content the better with respect to toughness. According to the present invention, the P content is restricted to 0.030% or less. However, it is preferable to further lower the P content when a relatively large amount of Si and Mn is incorporated. For this purpose, it is desirable to restrict the P content to not greater than 0.015%. From the viewpoint of steelmaking it is desirable to define the lower limit of the P content as 0.010% to avoid adding to manufacturing costs.

Precipitation of phosphorous along grain boundaries is suppressed by the addition of boron. This is because boron precipitates along the grain boundaries in preference to phosphorous, resulting in less precipitation of phosphorous. Thus, the austenite grain boundaries may be strengthened by the addition of B. This is the same as when the content of P is reduced.

(e) S (Sulfur)

The smaller the S content, the more effectively is the precipitation of MnS suppressed. This is desirable from the viewpoint of improving toughness. Therefore, the S content is defined as 0.020% or less, and preferably 0.01% or less.

(f) Nb (Niobium)

Nb is effective to refine austenite grains and to improve the toughness of the steel. Refinement of austenite grains is also very effective at suppressing hydrogen embrittlement fracture. When Nb is added in an amount of less than 0.005%, its effects are inadequate. On the other hand, when Nb is added in an amount of larger than 0.100%, the effectiveness of its addition saturates. Thus, the Nb content is restricted to 0.005–0.100%. Preferably, the ratio of Ti/Nb is about 0.3–0.7 so as to form a TiNb system precipitate.

(g) Cr (Chromium)

Cr is added mainly for the purpose of improving hardenability. When Cr is added in an amount of larger than 2.0%, the steel becomes hard, resulting in embrittlement. Therefore, the Cr content is restricted to 0.50–2.00%.

(h) Mo (Molybdenum)

The addition of Mo is important. It is effective for maintaining a high degree of toughness after heat treatment without degradation in formability before heat treatment (quenching and tempering) of steel sheet. Generally, when a steel is tempered at around 300° C. after quenching, a so-called "low temperature temper brittleness" occurs with a marked degradation in toughness. However, sometimes it is necessary to carry out low temperature tempering at around 300° C. in order to obtain a desirable level of hardness. In fact, there is a tendency for temper brittleness of a thin steel sheet to be less serious than that of a thick steel sheet, and that low temperature tempering may be employed for a thin steel sheet. However, even a very small deterioration in toughness is inevitable. The addition of Mo in an amount of 0.10% or larger is very effective for compensating for a reduction in toughness of this level. When the Mo content is larger than 0.50%, it adds to manufacturing costs, so the upper limit of Mo content is defined as 0.50%.

(i) Ti (Titanium)

Ti is effective for increasing the hardenability, hardness and tensile strength of steel by means of forming and finely dispersing TiN or TiC. Furthermore, Ti combines with Nb to form a complex precipitate TiNb(CN) which promotes refinement of austenite grains. When B is also added, the presence of Ti suppresses the precipitation of BN within a grain and the precipitation of P along grain boundaries to avoid a degradation in the resistance to mechanical shock and hydrogen embrittlement. However, when the Ti content is less than 0.005%, the above-mentioned advantages cannot be obtained. The addition of Ti in an amount of larger than 0.10% adds to manufacturing costs and results in hardening of the steel. The Ti content is defined as 0.005–0.10%. It is desirable to add Ti in an amount not exceeding the amount of Nb in order to form a TiNb system complex precipitate.

(j) sol. Al

Al is optionally added to steel as a deoxidizing agent. When the content of Al is over 0.10%, it adds to manufacturing costs and makes the resulting steel hard. In view of grain size control of an austenitic grain, the addition of an excess amount of Al is undesirable. Thus, the addition of Al in an amount of not greater than 0.10% is permissible.

(k) N (Nitrogen)

The incorporation of nitrogen is effective for improving the hardness and tensile strength of steel. The presence of nitrogen is also effective for suppressing grain growth of austenitic grains by the formation of AlN, TiN, and the like, resulting in an improvement in toughness. For this purpose the N content is restricted to larger than 0.0020%. However, when the N content is over 0.015%, formability before quenching is impaired because of an increase in hardness. Therefore, the upper limit is defined as 0.015%.

(l) B (Boron):

B is an optional element, but it is effective for improving hardenability and strengthening grain boundaries due to its presence in a dissolved form along grain boundaries. When B is added in an amount of 0.0005% or more, the occurrence of brittle fracture is markedly suppressed. However, its effectiveness saturates when it is added excessively, and manufacturing costs are unnecessarily increased. Thus, according to the present invention, the content of B is restricted to not greater than 0.0020%.

(m) Finishing Temperature

The finishing temperature is restricted to 800 ° C. or higher to prevent precipitation of proeutectoid ferrite before finishing rolling. The upper limit is preferably 880° C. to avoid cracking during pickling and cold rolling, the cracking being caused by an increase in the hardness of hot rolled steel sheet.

(n) Cooling Rate for Hot Rolled Steel Sheet:

In order to prepare a fine ferrite-pearlite crystal grain structure, not only the finishing temperature but also the cooling rate for hot-rolled steel sheet are important.

In general, it is said that the lower the cooling rate for ferrite the smaller and coarser the number of grains of proeutectoid ferrite. Such coarse grains of ferrite adversely affect the refinement of austenite grain structure and also result in an increase in a heat treatment time since it takes much time for carbon and alloying elements such as Mn, Cr, and Mo to diffuse in an austenitic temperature range. In order to avoid such disadvantages it is necessary to increase the cooling rate for hot rolled steel sheet. However, when the cooling rate after finishing rolling is smaller than 5° C./second, refinement of an austenite grain structure cannot be expected. On the other hand, when the cooling rate is over 40° C./second, the hardness of the steel sheet increases, resulting in cracking during pickling and cold rolling.

Thus, the cooling rate after finishing rolling is restricted to 5°-40° C./second. Preferably, the cooling rate is restricted to 10°-40° C., further preferably to 10°-20° C./second, since at a cooling rate of higher than 20° C./second the hot-rolled steel sheet becomes embrittled, sometimes resulting in cracking during pickling.

(o) Coiling Temperature

After cooling to 500°-700° C., preferably to 550°-650° C., the resulting hot rolled steel sheet is coiled at a temperature of 450°-650° C., preferably 550°-650° C. When the coiling temperature is over 650° C., proeutectoid ferrite is made coarse even if it is cooled under the above conditions so that an extended period of time is required for heat treatment after shaping. On the other hand, when it is coiled at a temperature lower than 450° C., the steel sheet is hardened, resulting in cracking during pickling and cold rolling. Therefore, in the present invention the coiling temperature is restricted to 450-650° C., preferably 550°-650° C.

(p) Cold rolling

According to a preferred embodiment of the present invention, the thus-resulting hot rolled steel sheet is, if necessary, subjected to cold rolling and then box annealing. The reduction in thickness during cold rolling is restricted to 20% or larger so as to ensure the required accuracy of the final thickness. The upper limit on the reduction is defined as 80% because a reduction in thickness of over 80% would result in cracking during cold rolling. Thus, according to the present invention, the reduction in thickness during cold rolling is preferably 20-80%.

(q) Annealing

In a preferred embodiment of the present invention after cold rolling spheroidizing annealing may be carried out to soften the cold-rolled steel sheet. The annealing conditions are defined as $(Ac_1-50)$ to $(Ac_1+30)$° C. depending on the type of alloying elements added. When the annealing temperature is lower than $(Ac_1-50)$° C., it takes a very long time to achieve spheroidization of cementites, making the process less efficient. On the other hand, when the temperature is higher than $(Ac_1+30)$° C., the ferrite-pearlite structure once again grows coarse, adversely increasing the length of heat treatment. Furthermore, the strength of the material increases with a deterioration in formability, i.e., pressing or forming into a final shape, which is carried out by customers. One hour or longer of soaking is necessary for spheroidizing precipitates. For this purpose box annealing is employed.

For the above reasons, in a preferred embodiment of the present invention, the annealing is carried out by box annealing at a temperature of $(Ac_1-50)$ to $(Ac_1+30)$° C. for one hour or longer. It is desirable to limit the processing period to at most 24 hours from the viewpoint of increasing productivity.

Thin steel sheet produced by the process of the present invention is, after purchased by customers, formed and shaped and then subjected to heat treatment to provide a sufficient level of hardness and properties required for the final products.

The present invention will be further described in conjunction with working examples which are presented merely for illustrative purposes and do not restrict the present invention in any way.

EXAMPLE 1

Steels A-H shown in Table 1 were hot rolled under the conditions indicated as Process No. 1 in Table 2.

From the resulting steel sheets, test pieces each having a thickness of 1 mm and a V-shaped notch at the center of an edge were cut. Austempering under the conditions shown in Table 3 was performed on these test pieces to provide a tensile strength of 120 kgf/mm$^2$. The thus-prepared test pieces were dipped into warm water at 50° C. under a load of 60 kgf/mm$^2$ to determine a length of time until fracture occurred on the test piece.

The test results are shown in FIG. 1.

It can be seen that Steels A through E are superior to Steels F through H with respect to resistance to cracking in the range of tensile strength of 150 kgf/mm$^2$ or higher. Among the steels shown in Table 1, only Steels A–E could satisfy target levels of 155 kgf/mm$^2$, for tensile strength and 55 hours for the length of time until cracking occurs.

EXAMPLE 2

In this example, Steels A, B and E of Table 1 were used. They had the same levels of Mn and Cr but differed with respect to their carbon content. Hot rolling was performed on these test steels under the conditions identified as Nos. 1 through 8 in Table 2. Hot rolling conditions Nos. 1 through 4 fell within the range of the present invention.

A hydrogen embrittlement test was performed on the resulting hot rolled steel sheet in the same manner as in Example 1. The results are shown graphically in FIGS. 2 through 4. The reference numerals for each graph indicate the number of the hot rolling conditions of Table 2.

Figure 2:
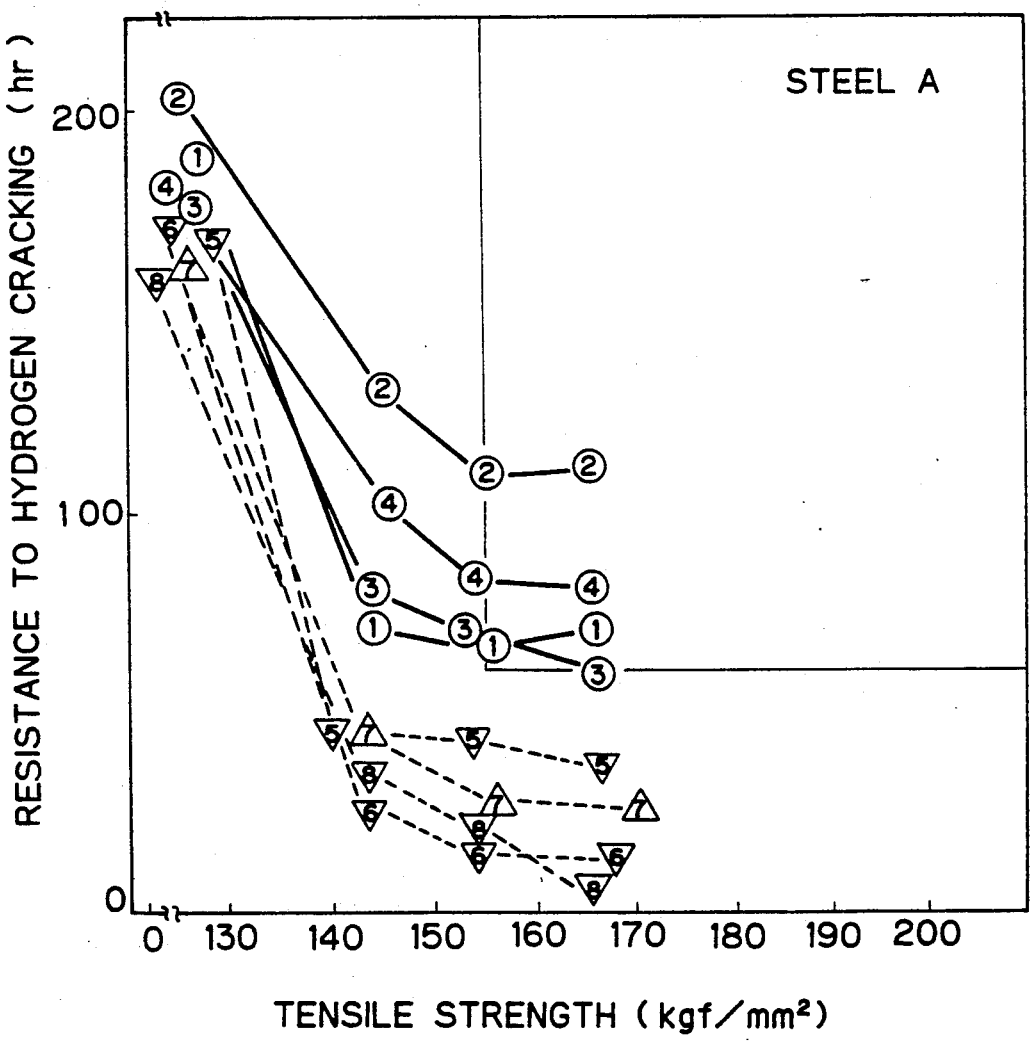

FIG. 2 indicates tensile strength and the resistance to hydrogen cracking for test pieces of steel A (0.34% of C) which were hot rolled under conditions Nos. 1–8. When the steel was hot rolled under conditions Nos. 1 through 4, the hot rolled steel could satisfy the target levels of tensile strength and the resistance to hydrogen cracking. However, the steel which was hot rolled under conditions Nos. 5–8 did not satisfy those target levels.

Figure 3:
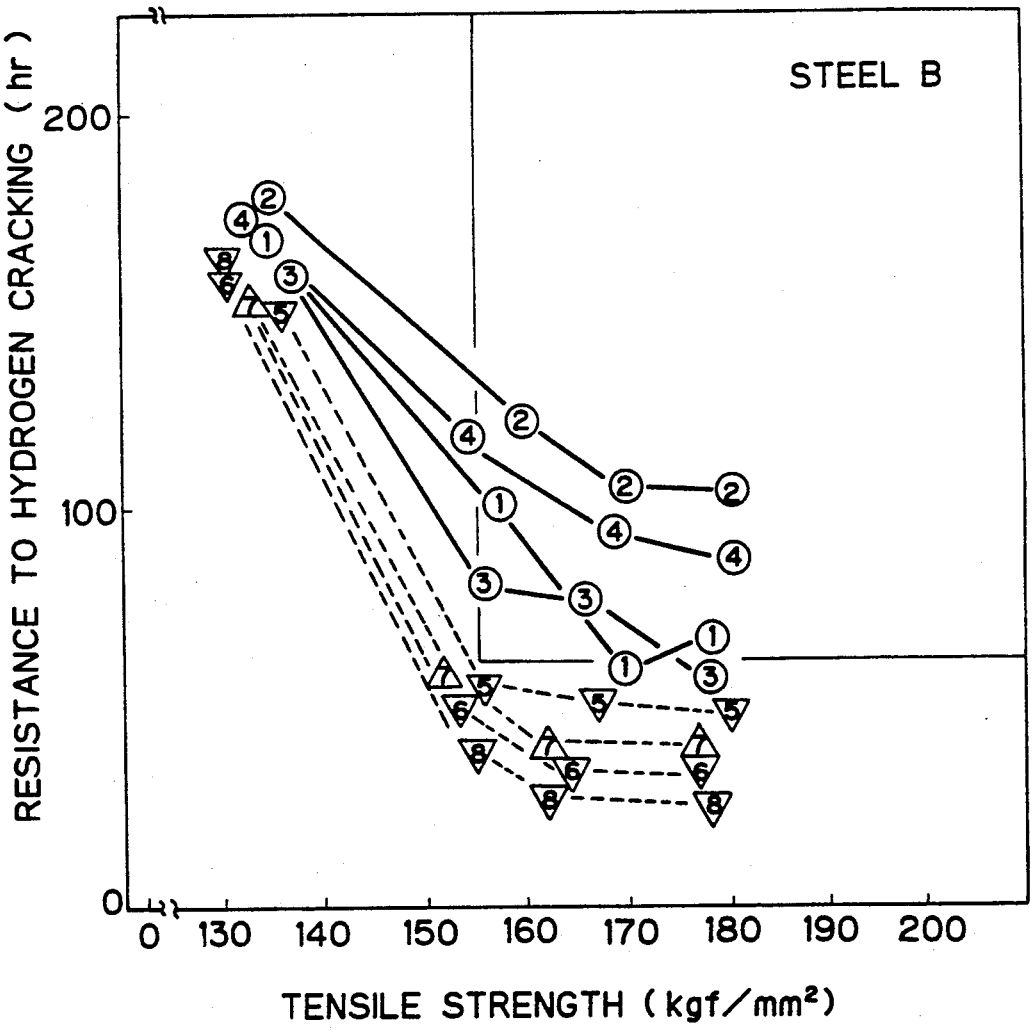

FIG. 3 indicates tensile strength and the resistance to hydrogen cracking for test pieces of steel B (0.51% of C) which were hot rolled under conditions Nos. 1–8. When the steel is hot rolled under conditions Nos. 1 through 4, some of the hot rolled steel satisfied the target levels of tensile strength and 20 resistance to hydrogen cracking. However, the steel which was hot rolled under conditions Nos. 5–8 did not satisfy the target levels at all.

Figure 4:
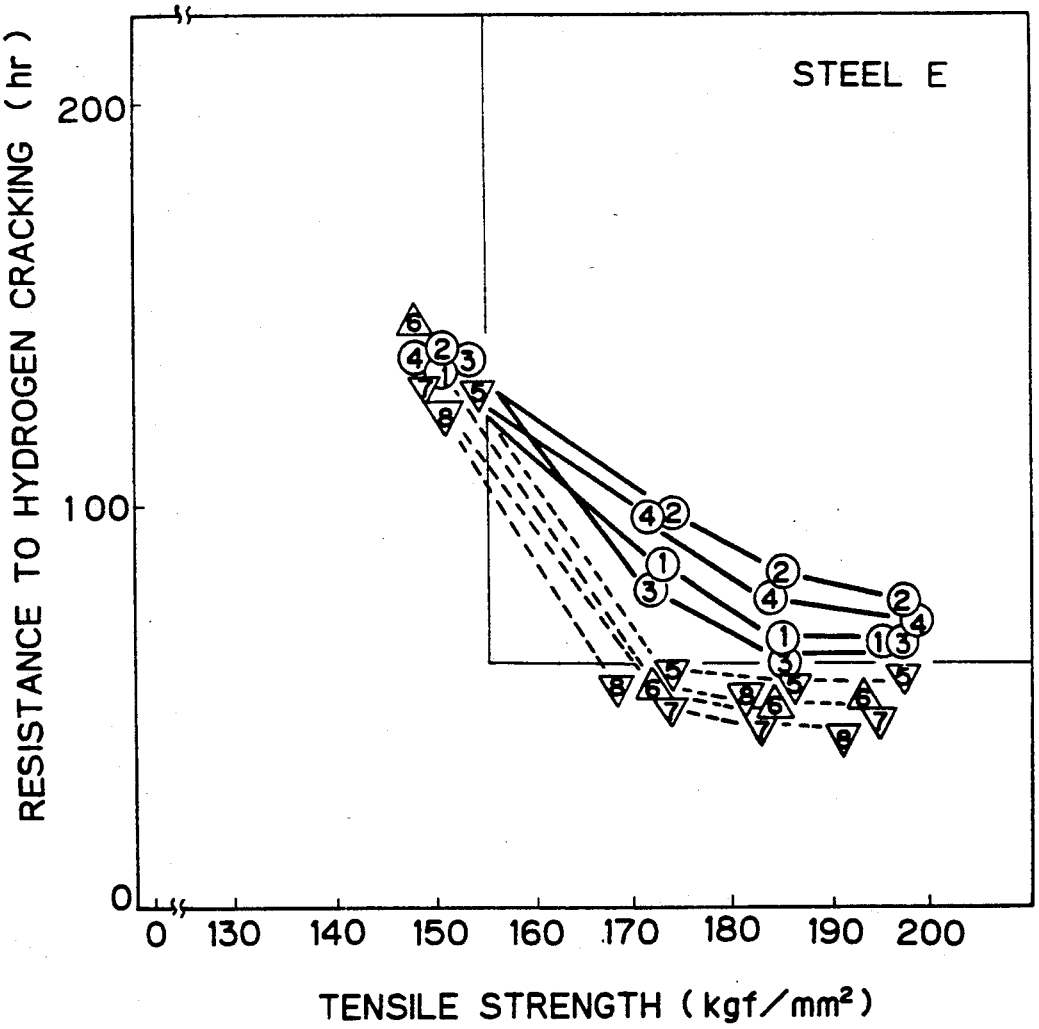

FIG. 4 indicates the tensile strength and the resistance to hydrogen cracking for test pieces of steel B (0.68% of C) which were hot rolled under conditions Nos. 1–8. When the steel was hot rolled under conditions Nos. 1 through 4, some of the hot rolled steel satisfied the target levels of tensile strength of 155 kgf/mm$^2$ or higher and resistance to hydrogen cracking of 55 hours or longer. However, the steel which was hot rolled under conditions Nos. 5–8 did not satisfy the target level at all.

Thus, it is apparent from the foregoing that a thin steel sheet hot rolled according to the present invention exhibits a remarkable improvement in tensile strength as well as resistance to hydrogen cracking after austempering.

EXAMPLE 3

In this example, Steels A through H of Table 1 were hot rolled under conditions Nos. 1 through 4 of Table 2, and the resulting steel sheets were subjected to cold rolling, and then box annealing under the conditions specified in Table 4. The occurrence of cracking along the edges during cold rolling and hardness after annealing were determined. The results are shown in Tables 5 through 8.

It is apparent from the results that steels cold rolled and annealed under conditions (a) through (d) of Table 4 were free from cracking at the edges and the hardness after annealing reached a level of lower than HRB of 85.

In contrast, the steel which was cold rolled and annealed under conditions (e) and (f) falling outside of the range of the present invention had a hardness of higher than HRB of 85 because of a lower annealing temperature or shorter annealing time. The steel processed under condition (g) suffered from cracking at the edges for every steel composition and every hot rolling condition because the reduction in thickness was too large. Furthermore, the steel processed under annealing condition (h) exhibited a hardness of larger than HBR of 85 because the reduction thickness was too small and spheroidizing of cementite after annealing did not occur sufficiently.

Thus, according to the preferred embodiments mentioned above, it is possible to soften the steel without causing cracking at the edges by cold rolling and annealing under conditions specified by the present invention.

EXAMPLE 4

In this example, Example 3 was repeated for the steels indicated in Table 9. After performing austempering on the resulting steels, the tensile strength and resistance to hydrogen embrittlement were determined in the same manner as in Example 1.

The results are shown in Table 10. A single asterisk shows the case in which processing conditions fell outside the range of the present invention and a double asterisk indicates the case in which processing conditions fell outside the range of the preferred embodiments of the present invention.

Although the present invention has ben described with preferred embodiments it is to be understood that variations and modifications may be employed without departing from the concept of the present invention as defined in the following claims.

TABLE 1

| Steel | C | Si | Mn | P | S | Cr | Mo | Ti | Nb | B | sol. Al | N | $Ac_1$ Point (°C.) |
|---|---|---|---|---|---|---|---|---|---|---|---|---|---|
| | | | | | | | Present Invention | | | | | | |
| A | 0.34 | 0.21 | 0.45 | 0.015 | 0.006 | 1.05 | 0.32 | 0.012 | 0.044 | 0.0012 | 0.044 | 0.0053 | 742.0 |
| B | 0.51 | 0.22 | 0.42 | 0.012 | 0.007 | 1.04 | 0.28 | 0.008 | 0.042 | 0.0013 | 0.048 | 0.0051 | 742.4 |
| C | 0.53 | 0.19 | 0.42 | 0.011 | 0.008 | 0.58 | 0.15 | 0.009 | 0.008 | 0.0007 | 0.048 | 0.0045 | 733.8 |
| D | 0.50 | 0.20 | 0.40 | 0.013 | 0.005 | 1.48 | 0.48 | 0.086 | 0.076 | 0.0018 | 0.047 | 0.0042 | 749.5 |
| E | 0.68 | 0.20 | 0.38 | 0.012 | 0.008 | 1.05 | 0.25 | 0.012 | 0.042 | 0.0014 | 0.046 | 0.0043 | 742.4 |
| | | | | | | | Comparative | | | | | | |
| F | 0.49 | 0.21 | *1.24 | *0.032 | 0.018 | 1.12 | 0.45 | 0.011 | 0.035 | 0.0012 | 0.062 | 0.005 | 734.7 |

TABLE 1-continued

| Steel | C | Si | Mn | P | S | Cr | Mo | Ti | Nb | B | sol. Al | N | $Ac_1$ Point (°C.) |
|---|---|---|---|---|---|---|---|---|---|---|---|---|---|
| G | 0.52 | 0.18 | 0.45 | 0.018 | 0.005 | 1.10 | 0.34 | *0.002 | 0.014 | 0.0005 | 0.071 | 0.004 | 742.0 |
| H | 0.53 | 0.22 | 0.38 | 0.015 | 0.006 | 1.08 | 0.30 | 0.009 | *0.003 | 0.0008 | 0.068 | 0.004 | 743.5 |

NOTE:
*Outside the Range of the Present Invention.

TABLE 2

| No. | Finishing Temp. (°C.) | Cooling Rate (°C./sec) | Coiling Temp. (°C.) |
|---|---|---|---|
| 1 | 850 | 15 | 600 |
| 2 | 850 | 35 | 560 |
| 3 | 840 | 10 | 640 |
| 4 | 830 | 20 | 570 |
| 5 | *780 | 20 | 620 |
| 6 | 860 | *5 | 650 |
| 7 | 840 | 10 | *690 |
| 8 | 850 | *5 | *500 |

NOTE:
*Outside the Range of the Present Invention.

TABLE 3

| | |
|---|---|
| Soaking Conditions | 845° C., 8 min |
| Austempering Conditions | 270° C., 40 min; 310° C., 40 min; |

TABLE 3-continued

| | |
|---|---|
| | 350° C., 40 min; 390° C., 40 min |

TABLE 4

| | Reduction (%) | Annealing Temp. (°C.) | Holding Time (h) |
|---|---|---|---|
| a | 25 | 695 | 16 |
| b | 70 | 700 | 12 |
| c | 50 | 685 | 16 |
| d | 50 | 745 | 2.5 |
| e | 50 | *630 | 12 |
| f | 50 | 700 | *0.5 |
| g | *85 | 710 | 12 |
| h | 60 | *820 | *0.1 |

NOTE:
*Outside the Range of the Present Invention.

TABLE 5

| Cold Rolling, Annealing Conditions | | Hot Rolling Conditions No. 1 | | | | | | | |
|---|---|---|---|---|---|---|---|---|---|
| | | a | b | c | d | *e | *f | *g | *h |
| Present Invention | A | ○○ | ○○ | ○○ | ○○ | ○○ | ○○ | X○ | ○○ |
| | B | ○○ | ○○ | ○○ | ○○ | ○X | ○X | X○ | ○X |
| | C | ○○ | ○○ | ○○ | ○○ | ○○ | ○○ | X○ | ○X |
| | D | ○○ | Δ○ | ○○ | ○○ | ○X | ○X | X○ | ○○ |
| | E | ○○ | Δ○ | ○○ | ○○ | ○X | ○X | X○ | ○X |
| Comparative | F | ○○ | ○○ | ○○ | ○○ | ○X | ○X | X○ | ○○ |
| | G | ○○ | ○○ | ○○ | ○○ | ○○ | ○X | X○ | ○X |
| | H | ○○ | ○○ | ○○ | ○○ | ○○ | ○○ | X○ | ○X |

Left Side = Edge Cracking During Cold Rolling. (○: No Cracking. Δ: Partially Occurred. X: Severe Cracking)
Right Side = Hardness After Cold Rolling and Annealing. (○: HRB < 85, X: HRB ≧ 85)
*Outside the Range of the Present Invention.
A bold line area indicates the case in which satisfactory results were not obtained.
This applies to Tables 6-8.

TABLE 6

| Cold Rolling, Annealing Conditions | | Hot Rolling Conditions No. 2 | | | | | | | |
|---|---|---|---|---|---|---|---|---|---|
| | | a | b | c | d | *e | *f | *g | *h |
| Present Invention | A | ○○ | ○○ | ○○ | ○○ | ○○ | ○○ | X○ | ○X |
| | B | ○○ | ○○ | ○○ | ○○ | ○X | ○X | X○ | ○X |
| | C | ○○ | ○○ | ○○ | ○○ | ○X | ○X | X○ | ○X |
| | D | ○○ | Δ○ | ○○ | ○○ | ○X | ○X | X○ | ○X |
| | E | ○○ | Δ○ | ○○ | ○○ | ○X | ○X | X○ | ○X |
| Comparative | F | ○○ | ○○ | ○○ | ○○ | ○X | ○X | X○ | ○X |
| | G | ○○ | ○○ | ○○ | ○○ | ○X | ○X | X○ | ○X |
| | H | ○○ | ○○ | ○○ | ○○ | ○○ | ○X | X○ | ○X |

TABLE 7

| Cold Rolling, Annealing Conditions | | Hot Rolling Conditions No. 3 a | b | c | d | *e | *f | *g | *h |
|---|---|---|---|---|---|---|---|---|---|
| Present Invention | A | ○○ | ○○ | ○○ | ○○ | ○○ | ○○ | X○ | ○○ |
| | B | ○○ | ○○ | ○○ | ○○ | ○○ | ○○ | X○ | ○○ |
| | C | ○○ | ○○ | ○○ | ○○ | ○○ | ○○ | X○ | ○○ |
| | D | ○○ | Δ○ | ○○ | ○○ | ○○ | ○○ | X○ | ○X |
| | E | ○○ | Δ○ | ○○ | ○○ | ○X | ○○ | X○ | ○X |
| Comparative | F | ○○ | ○○ | ○○ | ○○ | ○X | ○○ | X○ | ○○ |
| | G | ○○ | ○○ | ○○ | ○○ | ○○ | ○○ | X○ | ○○ |
| | H | ○○ | ○○ | ○○ | ○○ | ○○ | ○○ | X○ | ○○ |

TABLE 8

| Cold Rolling, Annealing Conditions | | Hot Rolling Conditions No. 4 a | b | c | d | *e | *f | *g | *h |
|---|---|---|---|---|---|---|---|---|---|
| Present Invention | A | ○○ | ○○ | ○○ | ○○ | ○X | ○X | X○ | ○○ |
| | B | ○○ | ○○ | ○○ | ○○ | ○X | ○X | X○ | ○ |
| | C | ○○ | ○○ | ○○ | ○○ | ○X | ○X | X○ | ○ |
| | D | ○○ | Δ○ | ○○ | ○○ | ○X | ○X | X○ | ○X |
| | E | ○○ | Δ○ | ○○ | ○○ | ○X | ○X | X○ | ○X |
| Comparative | F | ○○ | ○○ | ○○ | ○○ | ○X | ○X | X○ | ○X |
| | G | ○○ | ○○ | ○○ | ○○ | ○X | ○X | X○ | ○X |
| | H | ○○ | ○○ | ○○ | ○○ | ○X | ○X | X○ | ○X |

TABLE 9

| Steel No. | C | Si | Mn | P | S | Cr | Mo | Ti | Nb | B | sol. Al | N | $Ac_1$ Point (°C.) |
|---|---|---|---|---|---|---|---|---|---|---|---|---|---|
| 1 | 0.54 | 0.18 | 0.36 | 0.012 | 0.006 | 1.08 | 0.37 | 0.012 | 0.043 | — | 0.072 | 0.0043 | 742.7 |
| 2 | 0.32 | 0.21 | 0.35 | 0.011 | 0.008 | 1.04 | 0.38 | 0.012 | 0.043 | 0.0012 | 0.052 | 0.0046 | 742.9 |
| 3 | 0.68 | 0.21 | 0.38 | 0.012 | 0.007 | 1.03 | 0.37 | 0.013 | 0.038 | 0.0013 | 0.054 | 0.0048 | 742.4 |
| 4 | 0.48 | 0.12 | 0.37 | 0.011 | 0.006 | 1.04 | 0.37 | 0.013 | 0.037 | 0.0012 | 0.054 | 0.0043 | 737.1 |
| 5 | 0.56 | 0.64 | 0.37 | 0.012 | 0.007 | 0.97 | 0.39 | 0.013 | 0.041 | 0.0011 | 0.055 | 0.0044 | 754.0 |
| 6 | 0.56 | 0.21 | 0.13 | 0.006 | 0.007 | 0.98 | 0.37 | 0.015 | 0.039 | 0.0011 | 0.056 | 0.0045 | 744.2 |
| 7 | 0.54 | 0.20 | 0.95 | 0.011 | 0.007 | 0.98 | 0.38 | 0.014 | 0.038 | 0.0012 | 0.053 | 0.0047 | 735.2 |
| 8 | 0.55 | 0.21 | 0.38 | 0.018 | 0.018 | 0.98 | 0.37 | 0.014 | 0.038 | 0.0011 | 0.054 | 0.0046 | 741.6 |
| 9 | 0.56 | 0.19 | 0.37 | 0.013 | 0.008 | 0.52 | 0.13 | 0.015 | 0.039 | 0.0012 | 0.054 | 0.0046 | 733.3 |
| 10 | 0.54 | 0.18 | 0.38 | 0.014 | 0.008 | 1.86 | 0.48 | 0.015 | 0.042 | 0.0013 | 0.055 | 0.0045 | 755.6 |
| 11 | 0.63 | 0.21 | 0.36 | 0.013 | 0.007 | 1.02 | 0.32 | 0.006 | 0.041 | 0.0013 | 0.052 | 0.0045 | 742.4 |
| 12 | 0.48 | 0.21 | 0.39 | 0.013 | 0.009 | 1.02 | 0.34 | 0.094 | 0.042 | 0.0013 | 0.053 | 0.0047 | 742.1 |
| 13 | 0.52 | 0.19 | 0.39 | 0.013 | 0.006 | 1.02 | 0.41 | 0.021 | 0.008 | 0.0012 | 0.055 | 0.0044 | 741.5 |
| 14 | 0.54 | 0.19 | 0.38 | 0.012 | 0.005 | 1.01 | 0.40 | 0.016 | 0.078 | 0.0011 | 0.057 | 0.0043 | 741.5 |
| 15 | 0.54 | 0.19 | 0.39 | 0.011 | 0.007 | 1.03 | 0.40 | 0.015 | 0.038 | 0.0007 | 0.054 | 0.0041 | 741.7 |
| 16 | 0.55 | 0.19 | 0.38 | 0.011 | 0.007 | 0.99 | 0.40 | 0.015 | 0.038 | 0.0018 | 0.054 | 0.0048 | 741.1 |
| 17 | 0.53 | 0.20 | 0.38 | 0.012 | 0.006 | 0.98 | 0.38 | 0.016 | 0.039 | 0.0012 | 0.096 | 0.0046 | 741.3 |
| 18 | 0.55 | 0.21 | 0.38 | 0.012 | 0.008 | 0.98 | 0.39 | 0.016 | 0.041 | 0.0013 | 0.052 | 0.0038 | 741.6 |
| 19 | 0.55 | 0.20 | 0.39 | 0.013 | 0.009 | 1.02 | 0.38 | 0.015 | 0.042 | 0.0011 | 0.054 | 0.0135 | 741.8 |
| 20 | 0.48 | 0.20 | 0.41 | 0.012 | 0.009 | 1.01 | 0.37 | 0.015 | 0.043 | 0.0012 | 0.054 | 0.0061 | 741.5 |
| 21 | 0.53 | 0.18 | 0.40 | 0.012 | 0.008 | 0.97 | 0.40 | 0.016 | 0.041 | 0.0012 | 0.056 | 0.0063 | 740.3 |
| 22 | 0.53 | 0.19 | 0.41 | 0.011 | 0.007 | 0.98 | 0.39 | 0.014 | 0.039 | 0.0013 | 0.055 | 0.0063 | 740.7 |
| 23 | 0.54 | 0.21 | 0.41 | 0.011 | 0.006 | 0.99 | 0.38 | 0.014 | 0.039 | 0.0011 | 0.055 | 0.0064 | 741.4 |
| 24 | 0.53 | 0.21 | 0.32 | 0.012 | 0.008 | 0.99 | 0.37 | 0.014 | 0.038 | 0.0012 | 0.055 | 0.0062 | 742.4 |
| 25 | 0.55 | 0.20 | 0.38 | 0.012 | 0.007 | 1.04 | 0.39 | 0.016 | 0.035 | 0.0012 | 0.054 | 0.0065 | 742.3 |
| 26 | 0.56 | 0.21 | 0.38 | 0.013 | 0.009 | 1.04 | 0.40 | 0.017 | 0.040 | 0.0013 | 0.057 | 0.0062 | 742.6 |
| 27 | 0.51 | 0.18 | 0.39 | 0.014 | 0.007 | 1.02 | 0.40 | 0.015 | 0.041 | 0.0012 | 0.054 | 0.0060 | 741.3 |
| 28 | 0.52 | 0.18 | 0.40 | 0.012 | 0.006 | 1.00 | 0.35 | 0.015 | 0.040 | 0.0012 | 0.056 | 0.0062 | 740.8 |
| 29 | 0.55 | 0.19 | 0.38 | 0.013 | 0.009 | 1.00 | 0.38 | 0.014 | 0.042 | 0.0011 | 0.052 | 0.0061 | 741.3 |
| 30 | 0.54 | 0.20 | 0.39 | 0.012 | 0.008 | 0.97 | 0.38 | 0.016 | 0.040 | 0.0014 | 0.056 | 0.0063 | 741.0 |
| 31 | *0.25 | 0.21 | 0.38 | 0.011 | 0.008 | 1.01 | 0.32 | 0.012 | 0.043 | 0.0008 | 0.052 | 0.0048 | 742.1 |

TABLE 9-continued

| Steel No. | C | Si | Mn | P | S | Cr | Mo | Ti | Nb | B | sol. Al | N | $Ac_1$ Point (°C.) |
|---|---|---|---|---|---|---|---|---|---|---|---|---|---|
| 32 | *0.83 | 0.20 | 0.37 | 0.011 | 0.008 | 1.03 | 0.34 | 0.011 | 0.041 | 0.0012 | 0.054 | 0.0043 | 742.2 |
| 33 | 0.45 | 0.21 | 0.38 | 0.012 | 0.007 | 0.99 | 0.41 | *0.002 | 0.042 | *0.0001 | 0.054 | 0.0044 | 741.7 |
| 34 | 0.45 | 0.19 | 0.36 | 0.012 | 0.009 | 0.95 | 0.40 | *0.145 | 0.043 | *0.0031 | 0.055 | 0.0095 | 741.2 |
| 35 | 0.60 | 0.18 | 0.39 | 0.013 | 0.006 | 0.98 | 0.40 | 0.016 | *0.002 | 0.0013 | 0.056 | 0.0047 | 740.8 |
| 36 | 0.55 | 0.21 | 0.39 | 0.012 | 0.005 | 1.02 | 0.40 | 0.016 | *0.132 | 0.0012 | 0.053 | 0.0046 | 742.1 |
| 37 | 0.55 | 0.21 | 0.38 | 0.012 | 0.007 | 1.01 | 0.38 | 0.015 | 0.038 | 0.0011 | 0.054 | 0.0046 | 742.1 |
| 38 | 0.48 | 0.19 | 0.39 | 0.011 | 0.007 | 0.97 | 0.39 | 0.015 | 0.037 | 0.0011 | 0.054 | 0.0045 | 740.7 |
| 39 | 0.53 | 0.19 | 0.38 | 0.011 | 0.006 | 0.98 | 0.38 | 0.016 | 0.041 | 0.0012 | 0.055 | 0.0045 | 741.0 |
| 40 | 0.49 | 0.19 | 0.38 | 0.012 | 0.008 | 0.99 | 0.37 | 0.014 | 0.039 | 0.0011 | 0.052 | 0.0047 | 741.1 |
| 41 | 0.51 | 0.19 | 0.38 | 0.012 | 0.009 | 0.99 | 0.40 | 0.014 | 0.038 | 0.0012 | 0.053 | 0.0044 | 741.1 |
| 42 | 0.50 | 0.20 | 0.39 | 0.013 | 0.009 | 1.04 | 0.39 | 0.014 | 0.038 | 0.0013 | 0.055 | 0.0043 | 742.2 |
| 43 | 0.54 | 0.21 | 0.41 | 0.014 | 0.008 | 1.04 | 0.38 | 0.016 | 0.039 | 0.0013 | 0.057 | 0.0041 | 742.3 |
| 44 | 0.55 | 0.20 | 0.40 | 0.012 | 0.007 | 1.02 | 0.37 | 0.017 | 0.042 | 0.0013 | 0.054 | 0.0045 | 741.7 |
| 45 | 0.54 | 0.20 | 0.41 | 0.013 | 0.006 | 1.00 | 0.39 | 0.015 | 0.041 | 0.0012 | 0.054 | 0.0046 | 741.3 |

NOTE:
*Outside the Range of the Present Invention.

TABLE 10

| Run No. | Steel No. | Hot Rolling Conditions: Finishing Temp. (°C.) | Hot Rolling Conditions: Cooling Rate (°C./sec) | Hot Rolling Conditions: Coiling Temp. (°C.) | Cold Rolling-Annealing Conditions: Cold Rolling Reduction (%) | Cold Rolling-Annealing Conditions: Annealing Temp. (°C.) | Cold Rolling-Annealing Conditions: Holding Time (hr) | Austempering Conditions: Soaking (°C. × min) | Austempering Conditions: Autempering (°C. × min) | Tensile Strength (kgf/mm²) | Resistance to Hydrogen Cracking (hr) | Remarks |
|---|---|---|---|---|---|---|---|---|---|---|---|---|
| 1 | 1 | 850 | 25 | 590 | 50 | 675 | 20 | 870 × 10 | 330 × 40 | 186 | 125 | Present |
| 2 | 2 | 850 | 20 | 580 | 60 | 695 | 16 | 840 × 10 | 340 × 40 | 158 | 120 | Invention |
| 3 | 3 | 850 | 20 | 580 | 50 | 695 | 16 | " | " | 193 | 98 | |
| 4 | 4 | 840 | 15 | 600 | 50 | 700 | 16 | " | " | 182 | 96 | |
| 5 | 5 | 850 | 20 | 580 | 50 | 710 | 16 | " | " | 189 | 82 | |
| 6 | 6 | 840 | 20 | 600 | 45 | 695 | 16 | " | " | 178 | 148 | |
| 7 | 7 | 850 | 25 | 580 | 50 | 700 | 16 | " | " | 186 | 57 | |
| 8 | 8 | 845 | 20 | 600 | 50 | 700 | 16 | " | " | 169 | 56 | |
| 9 | 9 | 850 | 20 | 600 | 50 | 710 | 16 | " | " | 164 | 137 | |
| 10 | 10 | 850 | 25 | 580 | 60 | 710 | 16 | " | " | 189 | 74 | |
| 11 | 11 | 860 | 20 | 600 | 50 | 700 | 16 | " | " | 186 | 72 | |
| 12 | 12 | 845 | 15 | 620 | 55 | 700 | 16 | " | " | 187 | 86 | |
| 13 | 13 | 850 | 15 | 600 | 55 | 695 | 24 | " | " | 184 | 58 | |
| 14 | 14 | 855 | 15 | 620 | 55 | 695 | 24 | " | " | 188 | 126 | |
| 15 | 15 | 855 | 20 | 600 | 60 | 700 | 16 | " | " | 185 | 117 | |
| 16 | 16 | 855 | 20 | 620 | 50 | 700 | 16 | " | " | 188 | 121 | |
| 17 | 17 | 850 | 25 | 580 | 50 | 700 | 16 | " | " | 181 | 84 | |
| 18 | 18 | 860 | 25 | 580 | 60 | 695 | 24 | " | " | 184 | 72 | |
| 19 | 19 | 850 | 25 | 580 | 60 | 700 | 16 | " | " | 192 | 84 | |
| 20 | 20 | 820 | 15 | 600 | 45 | 695 | 24 | 840 × 10 | 340 × 40 | 186 | 56 | |
| 21 | 21 | 850 | 35 | 600 | 50 | 700 | 16 | " | " | 189 | 124 | |
| 22 | 22 | 840 | 12 | 620 | 50 | 700 | 16 | " | " | 183 | 60 | |
| 23 | 23 | 830 | 20 | 640 | 50 | 695 | 24 | " | " | 184 | 58 | |
| 24 | 24 | 840 | 20 | 550 | 50 | 700 | 24 | " | " | 187 | 146 | |
| 25 | 25 | 860 | 25 | 610 | 70 | 690 | 24 | " | " | 184 | 114 | |
| 26 | 26 | 840 | 20 | 620 | 25 | 700 | 16 | " | " | 185 | 120 | |
| 27 | 27 | 830 | 25 | 600 | 40 | 695 | 16 | " | " | 185 | 126 | |
| 28 | 28 | 840 | 15 | 600 | 50 | 740 | 12 | " | " | 187 | 112 | |
| 29 | 29 | 845 | 20 | 600 | 50 | 710 | 2 | " | " | 182 | 121 | |
| 30 | 30 | 850 | 20 | 610 | 50 | 700 | 24 | " | " | 186 | 124 | |
| 31 | 31 | 840 | 20 | 600 | 50 | 700 | 18 | 840 × 10 | 340 × 40 | 128 | 206 | Comparative |
| 32 | 32 | 850 | 15 | 580 | 55 | **695 | 16 | " | " | 214 | 25 | |
| 33 | 33 | 840 | 20 | 600 | 55 | **695 | 16 | " | " | 182 | 32 | |
| 34 | 34 | 850 | 20 | 600 | 55 | 700 | 16 | " | " | 212 | 46 | |
| 35 | 35 | 845 | 25 | 580 | 60 | 700 | 16 | " | " | 184 | 16 | |
| 36 | 36 | 850 | 20 | 600 | 50 | 710 | 16 | " | " | 188 | 76 | |
| 37 | 37 | *780 | 20 | 620 | 50 | 700 | 16 | " | " | 204 | 28 | |
| 38 | 38 | 840 | *60 | 600 | 60 | 700 | 16 | " | " | 187 | 84 | |
| 39 | 39 | 830 | *5 | 620 | 60 | 700 | 24 | " | " | 202 | 18 | |
| 40 | 40 | 840 | 25 | *720 | 45 | **695 | 24 | " | " | 203 | 16 | |
| 41 | 41 | 860 | 20 | *530 | 50 | 695 | 16 | " | " | 186 | 96 | |
| 42 | 42 | 840 | 15 | 620 | **15 | 700 | 16 | " | " | 184 | 84 | Present |
| 43 | 43 | 830 | 15 | 600 | 48 | **620 | 12 | " | " | 187 | 87 | Invention |
| 44 | 44 | 840 | 15 | 600 | 55 | **800 | **0.1 | " | " | 182 | 92 | |
| 45 | 45 | 845 | 20 | 600 | 50 | 700 | **0.5 | " | " | 186 | 91 | |

NOTE:
*Outside the Range of the Present Invention.
**Outside the Range of the preferred embodiments of the Present Invention.

What we claim is:

1. A method of manufacturing a thin steel sheet of high carbon steel which has a high level of strength and exhibits excellent resistance to hydrogen embrittlement after heat treatment and which has the following chemical composition which consists essentially of, by weight %.

C: 0.30–0.70%,
Si: 0.10–0.70%.
Mn: 0.05–1.00%,
P: not greater than 0.030%,
S: not greater than 0.020%,
Cr: 0.50–2.00%,
Mo: 0.10–0.50%,
Ti: 0.005–0.10%,
Nb: 0.005–0.100%,
B: 0–0.0020%,
sol. Al: not greater than 0.10%,
N: greater than 0.0020%, but not greater than 0.015%, and a balance of iron and incidental impurities, the method comprising the steps of:

hot rolling a steel having said chemical composition with a finishing temperature of 800° C. or higher;

immediately after finishing the hot rolling cooling the hot rolled steel sheet at a cooling rate of 5°–40° C./second to a temperature range of 500°–700° C., coiling the hot rolled steel sheet at a temperature of 450°14 650° C.; and carrying out at least one cold rolling step with a reduction of 20–80% and box annealing at a temperature range of $(Ac_1-50)$ to $(Ac_1+30)$° C.

2. A method of manufacturing a thin steel sheet as set forth in claim 1, wherein the B content is 0.0005–0.0020%.

3. A method of manufacturing a thin steel sheet as set forth in claim 1, wherein the Mn content is restricted to not greater than 0.80%.

4. A method of manufacturing a thin steel sheet as set forth in claim 1, wherein the S content is restricted to not greater than 0.010%.

5. A method of manufacturing a thin steel sheet as set forth in claim 1, wherein the ratio of Ti/Nb is 0.3–0.7.

6. A method of manufacturing a thin steel sheet as set forth in claim 1, wherein the cooling rate is restricted to 10–20° C./second.

7. A method of manufacturing a thin steel sheet as set forth in claim 1, further comprising a step of austempering the steel at a temperature and time sufficient to provide a bainitic grain structure.

8. A method of manufacturing a thin steel sheet as set forth in claim 7, wherein the steel has a tensile strength of at least 120 kgf/mm$^2$ after the austempering step.

* * * * *